US006966853B1

(12) United States Patent
Wilkerson et al.

(10) Patent No.: US 6,966,853 B1
(45) Date of Patent: Nov. 22, 2005

(54) HOCKEY TRAINING DEVICE

(76) Inventors: Jeremy Wilkerson, 3777 Evergreen, Hobart, IN (US) 46342; Richard Wilkerson, 5008 E. 13 Mile Rd., Warren, MI (US) 48092-4442

( * ) Notice: Subject to any disclaimer, the term of this patent is extended or adjusted under 35 U.S.C. 154(b) by 141 days.

(21) Appl. No.: 10/455,959

(22) Filed: Jun. 6, 2003

(51) Int. Cl.[7] ..... A63B 69/00; A63B 67/00
(52) U.S. Cl. ..... 473/446; 473/478; 473/421
(58) Field of Search ..... 473/446, 422, 473/415, 435, 451, 471, 478; 124/51.1; 273/375, 273/397, 121 R, 122 R, 127 C

(56) References Cited

U.S. PATENT DOCUMENTS 1,170,715 A * 2/1916 Westgate ..... 473/432
2,523,257 A * 9/1950 Firestone ..... 273/127 R
3,606,987 A * 9/1971 Yoshiro ..... 473/436
3,765,675 A 10/1973 Dimarzio
4,607,842 A 8/1986 Daoust
5,161,799 A * 11/1992 Nandra ..... 473/446
D361,609 S 8/1995 Bartlett
5,509,652 A 4/1996 Woronets
5,580,048 A 12/1996 Mullen et al.
5,707,304 A 1/1998 Belleisle
6,059,673 A * 5/2000 Mason ..... 473/478
6,379,272 B1 * 4/2002 Gorgo et al. ..... 473/421

* cited by examiner

*Primary Examiner*—Mitra Aryanpour

(57) ABSTRACT

A hockey training device for teaching hockey puck shooting. The hockey training device includes a panel having a front edge, a back edge, a first side edge and a second side edge, a top side and a bottom side. The top side has an apex extending from the front edge to the back edge such that the panel is divided into two portions angled toward opposite side edges of the panel. A platform is attached to and extends away from the front edge. A net is attached to the top side of the panel and is positioned nearer the back edge than the front edge. Each of a pair of conveyor belts is positioned along one of the first and second side edges of the panel such that pucks sliding down the panel move onto one of the conveyor belts. Each of a pair of motors rotates the conveyor belts.

7 Claims, 3 Drawing Sheets

HOCKEY TRAINING DEVICE

BACKGROUND OF THE INVENTION

1. Field of the Invention

The present invention relates to sport training devices and more particularly pertains to a new hockey training device for teaching hockey puck shooting.

2. Description of the Prior Art

The use of sport training devices is known in the prior art. More specifically, sport training devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,509,652; U.S. Pat. No. 4,607,842; U.S. Pat. No. 3,765,675; U.S. Pat. No. 5,580,048; U.S. Pat. No. 5,707,304; and U.S. Des. Pat. No. 361,609.

While these devices fulfill their respective, particular objectives and requirements, the aforementioned patents do not disclose a new hockey training device. The inventive device includes a panel having a front edge, a back edge, a first side edge and a second side edge, a top side and a bottom side. The top side has an apex extending from the front edge to the back edge and positioned between the first and second side edges such that a first portion and a second portion of the top side are defined. The first portion is angled toward the first side edge and the second portion is angled toward the second edge. A platform is attached to and extends away from the front edge. The platform lies in a generally horizontal orientated plane. A net is attached to the top side of the panel and is positioned nearer the back edge than the front edge. The net generally resembles a hockey goal having an open side facing the front edge. Each of a pair of conveyor belts is positioned along one of the first and second side edges of the panel and along sides of the platform such that pucks sliding down the panel move onto one of the conveyor belts. Each of a pair of motors is operationally coupled to one of the conveyor belts for rotating the conveyor belts in a first direction such that the pucks are moved toward the platform.

In these respects, the hockey training device according to the present invention substantially departs from the conventional concepts and designs of the prior art, and in so doing provides an apparatus primarily developed for the purpose of teaching hockey puck shooting.

SUMMARY OF THE INVENTION

In view of the foregoing disadvantages inherent in the known types of sport training devices now present in the prior art, the present invention provides a new hockey training device construction wherein the same can be utilized for teaching hockey puck shooting.

The general purpose of the present invention, which will be described subsequently in greater detail, is to provide a new hockey training device apparatus and method which has many of the advantages of the sport training devices mentioned heretofore and many novel features that result in a new hockey training device which is not anticipated, rendered obvious, suggested, or even implied by any of the prior art sport training devices, either alone or in any combination thereof.

To attain this, the present invention generally comprises a panel having a front edge, a back edge, a first side edge and a second side edge, a top side and a bottom side. The top side has an apex extending from the front edge to the back edge and positioned between the first and second side edges such that a first portion and a second portion of the top side are defined. The first portion is angled toward the first side edge and the second portion is angled toward the second edge. A platform is attached to and extends away from the front edge. The platform lies in a generally horizontal orientated plane. A net is attached to the top side of the panel and is positioned nearer the back edge than the front edge. The net generally resembles a hockey goal having an open side facing the front edge. Each of a pair of conveyor belts is positioned along one of the first and second side edges of the panel and along sides of the platform such that pucks sliding down the panel move onto one of the conveyor belts. Each of a pair of motors is operationally coupled to one of the conveyor belt for rotating the conveyor belts in a first direction such that the pucks are moved toward the platform.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hockey training device apparatus and method which has many of the advantages of the sport training devices mentioned heretofore and many novel features that result in a new hockey training device which is not anticipated, rendered obvious, suggested, or even implied by any of the prior art sport training devices, either alone or in any combination thereof.

It is another object of the present invention to provide a new hockey training device which may be easily and efficiently manufactured and marketed.

It is a further object of the present invention to provide a new hockey training device which is of a durable and reliable construction.

An even further object of the present invention is to provide a new hockey training device which is susceptible of a low cost of manufacture with regard to both materials and labor, and which accordingly is then susceptible of low prices of sale to the consuming public, thereby making such hockey training device economically available to the buying public.

Still yet another object of the present invention is to provide a new hockey training device which provides in the apparatuses and methods of the prior art some of the advantages thereof, while simultaneously overcoming some of the disadvantages normally associated therewith.

Still another object of the present invention is to provide a new hockey training device for teaching hockey puck shooting.

Yet another object of the present invention is to provide a new hockey training device which includes a panel having a front edge, a back edge, a first side edge and a second side edge, a top side and a bottom side. The top side has an apex extending from the front edge to the back edge and positioned between the first and second side edges such that a first portion and a second portion of the top side are defined. The first portion is angled toward the first side edge and the second portion is angled toward the second edge. A platform is attached to and extends away from the front edge. The platform lies in a generally horizontal orientated plane. A net is attached to the top side of the panel and is positioned nearer the back edge than the front edge. The net generally resembles a hockey goal having an open side facing the front edge. Each of a pair of conveyor belts is positioned along one of the first and second side edges of the panel and along sides of the platform such that pucks sliding down the panel move onto one of the conveyor belts. Each of a pair of motors is operationally coupled to one of the conveyor belts for rotating the conveyor belts in a first direction such that the pucks are moved toward the platform.

Still yet another object of the present invention is to provide a new hockey training device that allows a user to stand in generally one position while a plurality of pucks are passed to the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
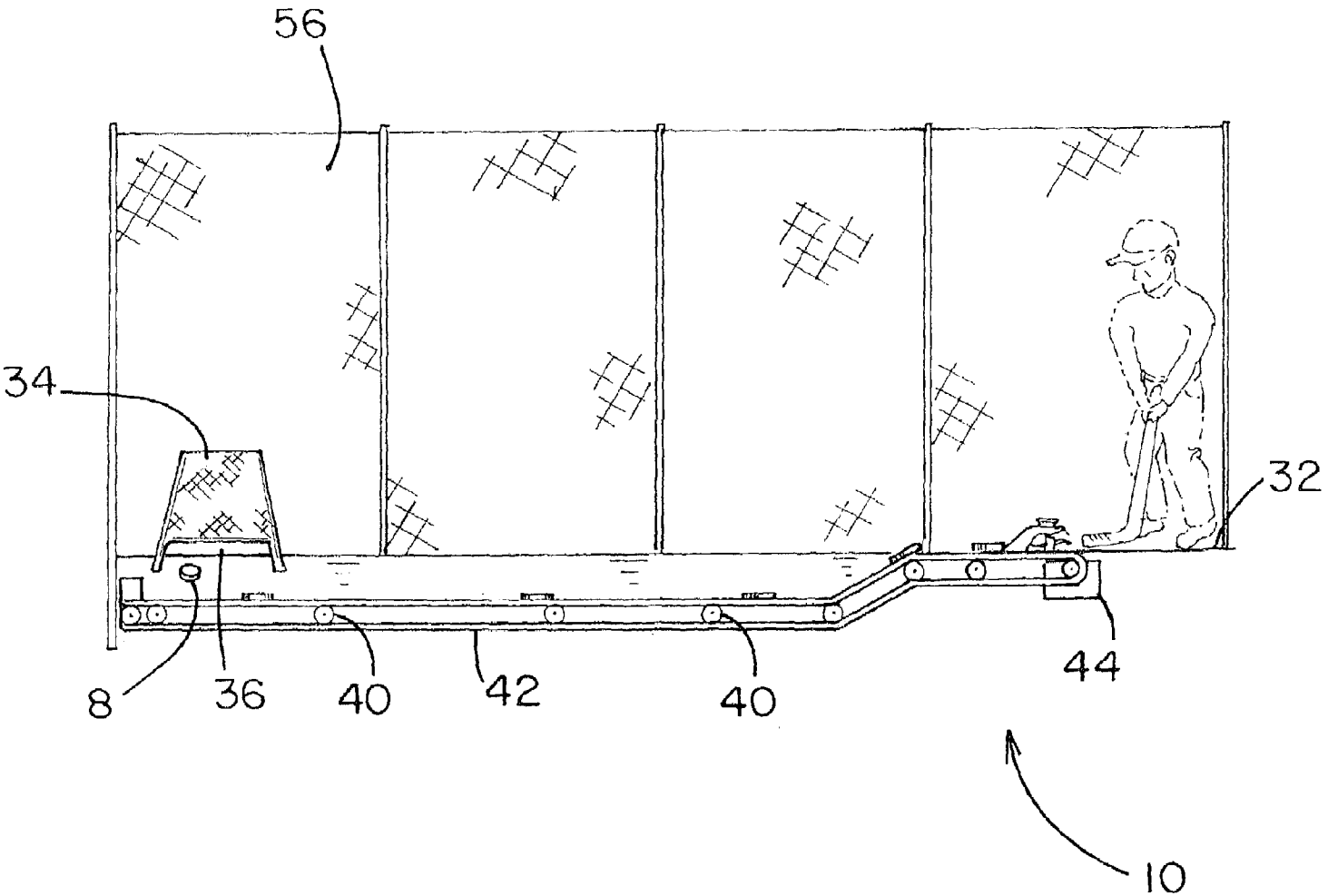
FIG. 1 is a schematic side view of a new hockey training device according to the present invention.
Figure 2:
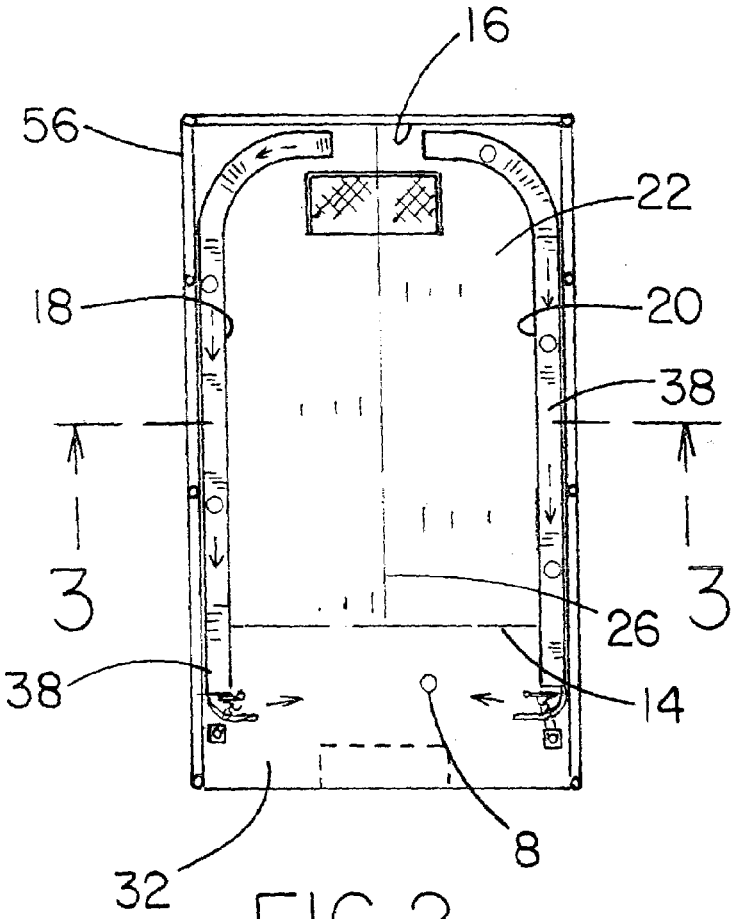
FIG. 2 is a schematic plan view of the present invention.
Figure 3:
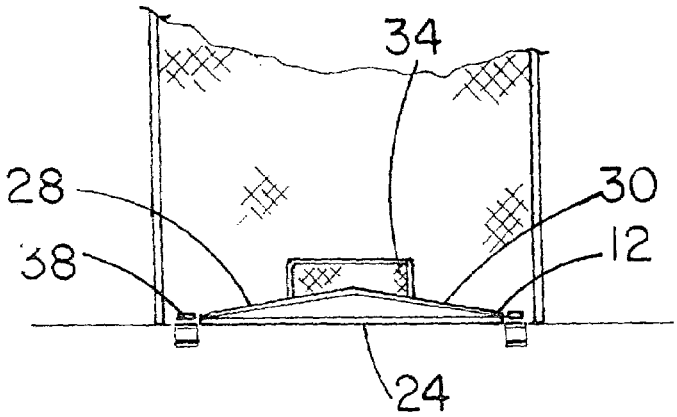
FIG. 3 is a schematic cross-sectional view taken along line 3—3 of FIG. 2 of the present invention.
Figure 4:
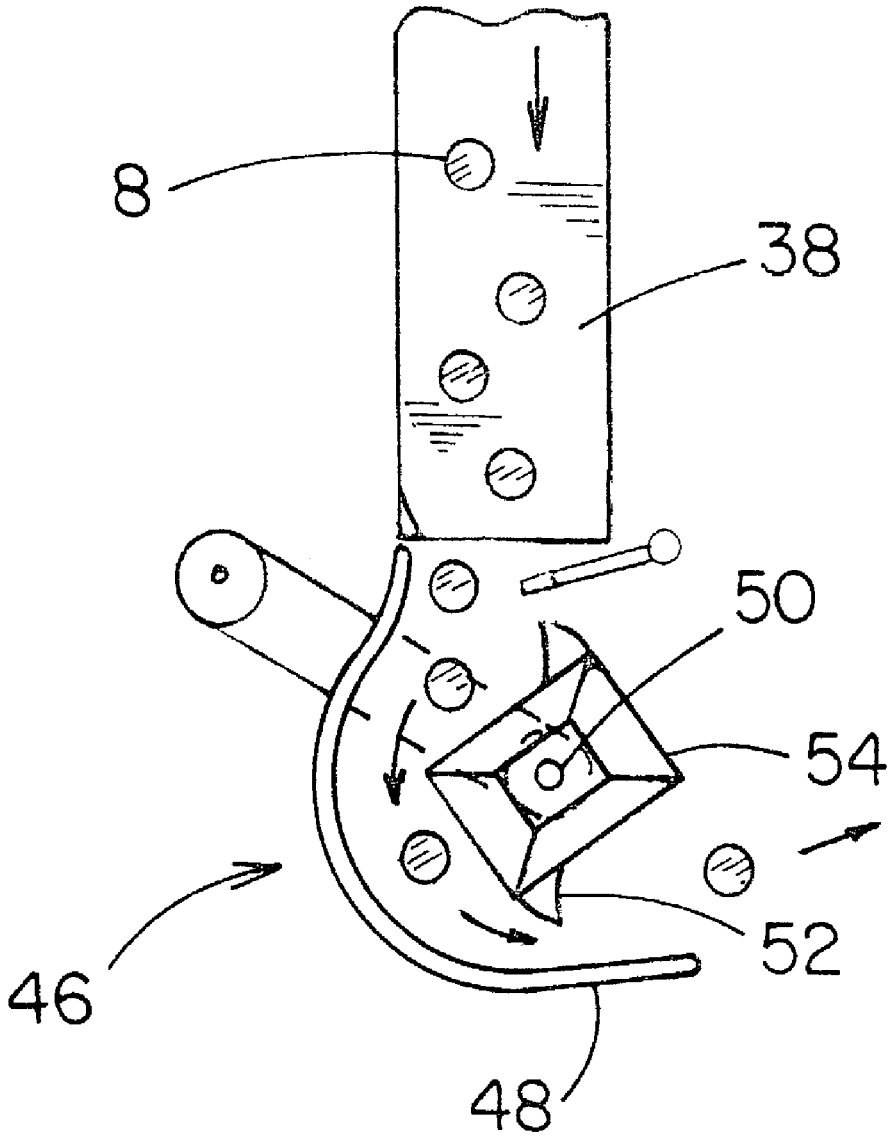
FIG. 4 is a schematic plan view of the puck ejector of the present invention.

With reference now to the drawings, and in particular to FIGS. 1 through 6 thereof, a new hockey training device embodying the principles and concepts of the present invention and generally designated by the reference numeral 10 will be described.

As best illustrated in FIGS. 1 through 4, the hockey training device 10 generally comprises a panel 12 having a front edge 14, a back edge 16, a first side edge 18 and a second side edge 20, a top side 22 and a bottom side 24. The top side 22 has an apex 26 extending from the front edge 14 to the back edge 16 and positioned between the first 18 and second 20 side edges such that a first portion 28 and a second portion 30 of the top side 22 are defined. The first portion 28 is angled toward the first side edge 18 and the second portion 30 is angled toward the second edge 20.

A platform 32 is attached to and extends away from the front edge 14. The platform 32 lies in a generally horizontal orientated plane.

A net 34 is attached to the top side 22 of the panel 12 and is positioned nearer the back edge 16 than the front edge 14. The net 34 generally resembles a hockey goal and has an open side facing the front edge 14. The net 34 has bottom sides having openings 36 therein such that hockey pucks 8 entering the net 34 may slide down the top side 22 of the panel 12 through the openings 36.

Each of a pair of conveyor belts 38 is positioned along one of the first 18 and second 20 side edges of the panel 12 and along sides of the platform 32 such that pucks 8 sliding down the panel 12 move onto one of the conveyor belts 38. The conveyor belts are assemblies of rollers 40 rotatably coupled to the side edges and belts 42 extending over the rollers 40.

Each of a pair of motors 44 is operationally coupled to one of the conveyor belts 38 for rotating the conveyor belts 38 in a first direction such that the pucks 8 are moved toward the platform 32.

Each of a pair of puck ejecting devices 46 is positioned adjacent to an end of one of the conveyor belts 38 and ejects the pucks 8 toward a central area of the platform 32. Each of the ejecting devices 46 includes a railing 48 positioned on an outside of the conveyor belt 38 with respect to the platform 32 and extends in an arc toward the platform 32.

A rod 50 extends upwardly through the platform 32 and positioned at an axis of an arc of the railing 48. The rod 50 is rotatably coupled to the platform 32. The rod 50 is operationally coupled by a belt to the motor 44 such that the motor 44 rotates the rod 50.

A plurality of elongate members 52 is coupled to and extends outwardly from the rod 50 such that the elongate members 52 engage the pucks 8 and move the pucks 8 onto the platform 32. Ideally angled plates 54 are positioned between the elongate members 52 and are angled downward to prevent jamming of the pucks 8.

A fence 56 is preferably coupled to and extends upwardly from the back edge 16 and the side edges 18, 20.

In use, a user stands on the platform 32 and hits hockey pucks toward the net 34. The pucks 8 slide off of the panel 12 and onto one of the conveyor belts 38. The conveyor belts 38 carry the pucks 8 to the puck ejectors 46 which eject the puck 8 so that the user may strike the puck 8 as it moves toward them. This aids the user in learning shooting and puck handling skills.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A hockey practicing device for hitting hockey pucks on and retrieving said hockey pucks, said device comprising:

a panel having a front edge, a back edge, a first side edge and a second side edge, a top side and a bottom side, said top side having an apex extending from said front edge to said back edge and positioned between said first and second side edges such that a first portion and a second portion of said top side are defined, said first portion being angled toward said first side edge and said second portion being angled toward said second edge;

a platform being attached to and extends away from said front edge, said platform lying in a generally horizontal orientated plane;

a net being attached to said top side of said panel and being positioned nearer said back edge than said front edge, said net generally resembling a hockey goal having an open side facing said front edge;

a pair of conveyor belts, each of said conveyor belts being positioned along one of said first and second side edges of said panel and along sides of said platform such that pucks sliding down said panel move onto one of said conveyor belts; and each of a pair of motors being operationally coupled to one of said conveyor belts for rotating said conveyor belts in a first direction such that said pucks are moved toward said platform.

2. The hockey practicing device as in claim 1, wherein said net having bottom sides having openings therein such that said hockey pucks entering said net may slide down said top side of said panel through said openings.

3. The hockey practicing device as in claim 1, further including:

a pair of puck ejecting devices each positioned adjacent to an end of one of said conveyor belts and ejecting said pucks toward a central area of said platform.

4. The hockey practicing device as in claim 1, wherein each of said ejecting devices comprises:

a railing positioned on an outside of said conveyor belt with respect to said platform and extending in an arc toward said platform;

a rod extending upwardly through said platform and positioned at an axis of an arc of said railing, said rod being rotatably coupled to said platform, said rod being operationally coupled to said motor such that said motor rotates said rod; and a plurality of elongate members being coupled to and extending outwardly from said rod such that said elongate members engage said pucks and move said pucks onto said platform.

5. The hockey practicing device as in claim 3, further comprising:

a fence being coupled to and extending upwardly from said back edge and said side edges.

6. The hockey practicing device as in claim 1, further comprising:

a fence being coupled to and extending upwardly from said back edge and said side edges.

7. A hockey practicing device for hitting hockey pucks on and retrieving said hockey pucks, said device comprising:

a panel having a front edge, a back edge, a first side edge and a second side edge, a top side and a bottom side, said top side having an apex extending from said front edge to said back edge and positioned between said first and second side edges such that a first portion and a second portion of said top side are defined, said first portion being angled toward said first side edge and said second portion being angled toward said second edge;

a platform being attached to and extends away from said front edge, said platform lying in a generally horizontal orientated plane;

a net being attached to said top side of said panel and being positioned nearer said back edge than said front edge, said net generally resembling a hockey goal having an open side facing said front edge, said net having bottom sides having openings therein such that said hockey pucks entering said net may slide down said top side of said panel through said openings;

a pair of conveyor belts, each of said conveyor belts being positioned along one of said first and second side edges of said panel and along sides of said platform such that pucks sliding down said panel move onto one of said conveyor belts;

each of a pair of motors being operationally coupled to one of said conveyor belts for rotating said conveyor belts in a first direction such that said pucks are moved toward said platform;

a pair of puck ejecting devices each positioned adjacent to an end of one of said conveyor belts and ejecting said pucks toward a central area of said platform, each of said ejecting devices comprising;

a railing positioned on an outside of said conveyor belt with respect to said platform and extending in an arc toward said platform;

a rod extending upwardly through said platform and positioned at an axis of an arc of said railing, said rod being rotatably coupled to said platform, said rod being operationally coupled to said motor such that said motor rotates said rod;

a plurality of elongate members being coupled to and extending outwardly from said rod such that said elongate members engage said pucks and move said pucks onto said platform; and a fence being coupled to and extending upwardly from said back edge and said side edges.

* * * * *